US005676873A

United States Patent [19]

Takase et al.

[11] Patent Number: 5,676,873

[45] Date of Patent: Oct. 14, 1997

[54] MICROWAVE OVEN AND MAGNETRON WITH COLD CATHODE

[75] Inventors: Takeo Takase, Kashiwa; Masao Urayama, Misato; Terutaka Tokumaru, Atsugi; Minoru Makita, Nara; Seiki Yano, Kashiwa, all of Japan

[73] Assignee: Sharp Kabushiki Kaisha, Osaka, Japan

[21] Appl. No.: 492,756

[22] Filed: Jun. 21, 1995

[30] Foreign Application Priority Data

Jun. 28, 1994 [JP] Japan ..... 6-146781
Feb. 21, 1995 [JP] Japan ..... 7-032385

[51] Int. Cl.[6] ..... H05B 6/64; H01J 25/50

[52] U.S. Cl. ..... 219/761; 219/715; 315/39.51; 315/39.57; 315/39.71; 331/86

[58] Field of Search ..... 315/39.51, 39.53, 315/39.57, 39.63, 39.67, 39.71; 219/761, 715, 716; 331/86

[56] References Cited

U.S. PATENT DOCUMENTS

| | | | |
|---|---|---|---|
| 3,104,303 | 9/1963 | Crapuchettes | 219/761 |
| 3,109,123 | 10/1963 | Spencer . | |
| 3,794,879 | 2/1974 | Edwards | 219/761 |
| 5,124,664 | 6/1992 | Cade et al. | 330/45 |
| 5,159,241 | 10/1992 | Kato et al. | 315/39.51 |
| 5,162,698 | 11/1992 | Kato et al. | 315/39.51 |
| 5,442,255 | 8/1995 | Ise et al. | 313/495 |

FOREIGN PATENT DOCUMENTS

| | | |
|---|---|---|
| 0593768 | 4/1994 | European Pat. Off. . |
| 1306999 | 11/1961 | France . |
| 84131 | 4/1963 | France . |

OTHER PUBLICATIONS

Kopylov, M.F., "Activation, stabilization degradation, and lifetime predictions of refractory thin films emitters operated in cold cathode magnetrons", *Journal of Vacuum Science and Technology*, Part B, vol. 12, No. 2, Mar. 1994–Apr. 1994, pp. 700–702.

McIntyre, P.M. et al., "Gigatron", *IEEE Transactions of Electron Devices*, vol. 36, No. 11, Nov. 1, 1989, pp. 2720–2727.

"The Magnetron–Type Traveling–Wave Amplifier Tube", Proceedings Of The I.R.E., pp. 486–495, 1960.

"FEA Crossed–Field Microwave Amplifier", pp. 70–71; Progress In Field–Emitter Development For Gigahertz Operation, pp. 148–149; and Proposal Of A High Efficiency Microwave Power Source Using A Field Emission Array, pp. 153–154, 6th IVMC, 1993.

*Primary Examiner*—Philip H. Leung

[57] ABSTRACT

There is provided a magnetron comprising a cold cathode having an electron emitting member which is formed linearly or as a plane on a substrate to emit electrons a subdivided anode disposed oppositely in parallel with the electron emitting member, the subdivided anode having cavity resonators formed therein at the side of the cold cathode, and a magnet which producing a magnetic field lying at right angles to an electric field applied between the cold cathode and the subdivided anode. There is also provided a microwave oven for dielectric-heating a substance to be heated by using the magnetron as a microwave supply source.

26 Claims, 11 Drawing Sheets

MICROWAVE OVEN AND MAGNETRON WITH COLD CATHODE

BACKGROUND OF THE INVENTION

1. Field of the Invention

The present invention relates to a novel magnetron which generates microwave utilizing electrons emitted from a cathode by applying an electric field in vacuum, and a microwave oven for dielectric-heating a substance to be heated using the novel magnetron as a microwave supply source.

2. Description of the Prior Art

A magnetron is an oscillator which can generate powerful electromagnetic oscillations with high efficiency in the centimeter and millimeter regions, and is used as a microwave supply source for a microwave oven and the like. FIG. 1 is a structural view of a conventional magnetron, in which a plurality of vanes 61 is radially shaped to protrude from an inner surface of a hollow anode cylinder 60 to the central axis thereof. The anode cylinder 60 and the vane 61 constitute a cavity resonator.

A cathode 62 is disposed on the central axis of the anode cylinder 60, and a space defined by the cathode 62 and the vane 61 is an interaction space 63. Pole pieces 64*a* and 64*b* are attached to the anode cylinder 60 at the upper and lower ends thereof to create a magnetic field uniformly in the interaction space 63, and magnets 65*a* and 65*b* are closely fixed to the pole pieces 64*a* and 64*b*, respectively. A plurality of heat-radiating plates 67 is disposed between the anode cylinder 60 and a yoke 66.

In this configuration, electrons are emitted from the cathode 62 toward the vane 61 with the inside of the anode cylinder 60 evacuated, in response to the application of the magnetic field to the interaction space 63 by the magnets 65*a*, 65*b*, and further to the application of a high voltage in between the cathode 62 and the vane 61 through an input member 68. The emitted electrons advance with a cycloidal motion toward the vane 61 in the interaction space 63 as they undergo the force of the magnetic field induced by the magnets 65*a*, 65*b*. The electrons advancing with a cycloidal motion in the interaction space 63 give energy to the cavity resonators, so that the energy is extracted through an output member 69 as microwave radiation.

A hot cathode filament is used in the cathode 62. Since conventional magnetrons are for diode operation, it is quite difficult to provide a variable high frequency output. Therefore, in the case of applying for, for example, a home use microwave oven, output is controlled by means of changing time-average output while duty of electric field application between the cathode and the anode is made variable. Recently, an inverter power source is used.

The conventional magnetron, due to the use of the hot cathode, requires electric power for heating the filament, and furthermore, a certain time delay occurs until the magnetron reaches steady-state operation after voltage application between the cathode and the anode. The output of the magnetron of the type described is controlled by means of varying duty factor of applied voltage between the cathode and the anode.

However, in the event of heating food products, the above mentioned method varying duty factor has less or no effect in terms of thermal control, because food products generally have large heat capacity, and it is difficult to achieve a desired temperature. Use of the inverter power source is effective but is disadvantageous by economical and cost considerations. If the operating voltage can be set at commercial voltage or less, a high-voltage transformer becomes unnecessary, and cost reduction can be achieved.

In the event of equipping a microwave oven with the conventional magnetron, a heating room housing and an anode of the magnetron are electrically connected. This makes it necessary to insulate a power source supply from a primary circuit. The operating voltage is as high as several thousand volts. It is thus very dangerous when getting an electric shock, which places requirements for high insulating performance against high voltage in the power source. Furthermore, the lifetime of the magnetron is inherently shortened as a result of filament deterioration because of a hot cathode.

In addition, the conventional magnetron does not have an output control function. Accordingly, the microwave radiation may be changed only by means of either intermittent duty control or control with a high frequency inverter power source. Further, for commercial-use microwave ovens having two or more magnetrons to provide a large output and the like, output control thereof requires independent high voltage power sources for individual magnetrons. Such system thus tends to be very large and expensive.

In the conventional microwave oven, when the anode of the magnetron is heated to a higher temperature, the temperature is reduced by means of disconnecting the power source supply to the magnetron, but it causes a problem that cooking is interrupted.

For a commercial-use microwave oven providing a large output through parallel operation of a plurality of magnetrons, a coupling state between the individual magnetrons and food to be heated may be varied depending on different shapes of the food. The problem is that some magnetrons would be operated at a low efficiency. Further, microwave ovens using a semiconductor device as an oscillator are not applicable practically and commercially due to its low conversion efficiency, since such oscillation is quite different from oscillation of the microwave caused by coupling of cavity resonators and electrons with a cycloidal motion in a magnetic field.

SUMMARY OF THE INVENTION

Therefore, an object of the present invention is to provide a novel magnetron using a cold cathode. Another object of the present invention is to provide a cost-saving microwave oven capable of being operated at a low voltage and of controlling readily output by using this novel magnetron as a microwave supply source.

In an aspect of the present invention, there is provided a magnetron comprising a cold cathode having an electron emitting member, for emitting electrons, which is formed linearly or plainly on a substrate, a subdivided anode which is disposed oppositely in parallel with the electron emitting member and which has cavity resonators formed therein at the side of the cold cathode, and a magnet producing a magnetic field lying at right angles to an electric field applied between the cold cathode and the subdivided anode.

In another aspect of the present invention, there is provided a magnetron comprising a cold cathode having an electron emitting member for emitting electrons, disposed at a central part thereof, a subdivided anode concentrically disposed around the periphery of the cold cathode, and a magnet producing a magnetic field lying at right angles to an electric field applied between the cold cathode and the subdivided anode.

In further aspect of the present invention, there is provided a microwave oven for dielectric-heating a substance to be heated, which is placed in a heating room of the oven with microwave Generated by a microwave supply source, wherein the microwave supply source is a magnetron comprising a cold cathode having an electron emitting member for emitting electrons, a subdivided anode disposed oppositely in parallel with the electron emitting member, the subdivided anode having cavity resonators formed therein at the side of the cold cathode, and a magnet producing a magnetic field lying at right angles to an electric field applied between the cold cathode and the subdivided anode.

DESCRIPTION OF THE PREFERRED EMBODIMENTS

Figure 1:
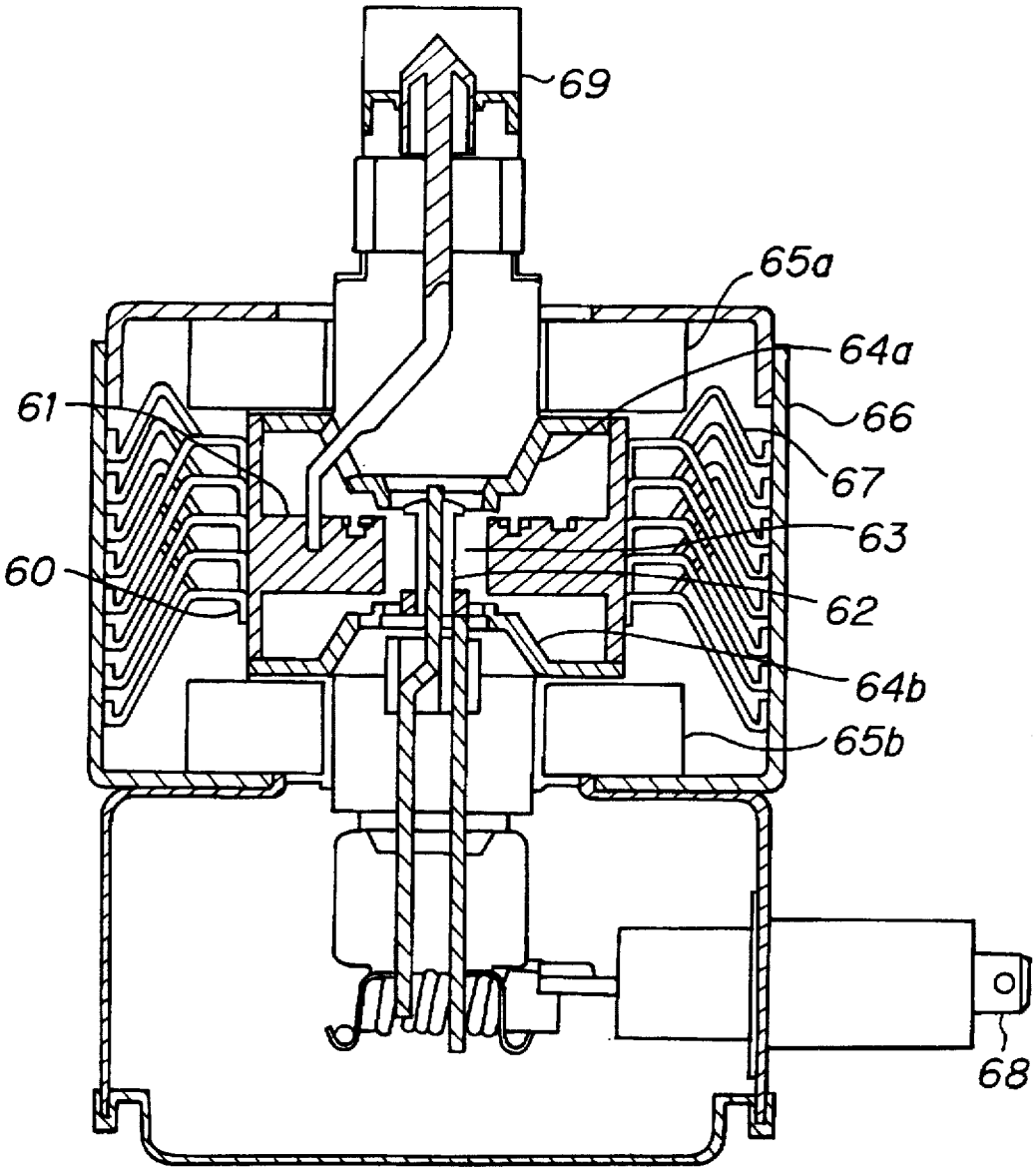
Fig.1 Prior Art
FIG. 1 is a schematic cross-sectional view of a conventional magnetron.

As mentioned above, one aspect of the present invention relates to a novel magnetron using a cold cathode. This magnetron includes a cold cathode having an electron emitting member, for emitting electrons, which is formed linearly or as a plane on a substrate, a subdivided anode which is disposed oppositely in parallel with the electron emitting member and which has cavity resonators formed therein at the side of the cold cathode, and a magnet which produces a magnetic field lying at right angles to an electric field applied between the cold cathode and the subdivided anode. Another aspect of the present invention also relates to a novel magnetron using a cold cathode. This magnetron includes a cold cathode having an electron emitting member for emitting electrons which is disposed at a central part thereof, a subdivided anode concentrically disposed around the periphery of the cold cathode, and a magnet which produces a magnetic field lying at right angles to an electric field applied between the cold cathode and the subdivided anode.

It is preferable that the electron emitting member is composed of field-emission cold cathode arrays. In addition, it is preferable that the length of the electron emitting member is $2\pi mE/eB^2$ or shorter relative to the moving direction of the electrons emitted from the electron emitting member, wherein $\pi$ is the ratio of the circumference of a circle to its diameter, m is mass of an electron, E is an applied electric field, e is an amount of elementary electric charge, and B is a magnetic field.

For the magnetron having this type of configuration, a cold cathode as a cathode of a magnetron, which has been developed and advanced rapidly in recent years, eliminates the necessity of heating a filament which otherwise is required in conventional hot cathodes. This permits reduction of power consumption and immediate operation without causing any time delay after application of a driving voltage.

Further, this novel magnetron can be operated at commercial power source voltage or less as operational voltage between the anode and the cathode thereof, and there is eliminated the necessity for a high voltage transformer which is essential for the operation of conventional magnetrons. Large cost reduction can thus be achieved.

Specifically, the length of the electron emitting member defined in the above mentioned range prevents electrons emitted from the electron emitting member from entering to the gate electrode after the electrons are turned by the magnetic field. As a result, the current flowing through the gate electrode becomes significantly small, which in turn permits the reduction of the current-capacity and the size of the power source controlling the gate voltage. Further, this results in inhibiting a temperature increase at the gate electrode and gas discharge from the gate electrode (discharge of gas adsorbed on the surface), improving yield and life of a device.

It is preferable that the magnetron provided by the present invention have a high frequency output changing means for changing a high frequency output by controlling the amount of electrons emitted from the electron emitting member. Alternatively, the magnetron preferably has a gate electrode formed on the electron emitting member and a high frequency output changing means for changing a high frequency output by controlling gate voltage applied to the gate, and thereby controlling the amount of electrons emitted from the electron emitting member. Further, it is preferable to divide the electron emitting member into two or more sections and to change high frequency output by independently controlling these two or more sections of the electron emitting member.

Therefore, in the magnetron provided by the present invention, the control to change the high frequency output can easily be achieved by having a high frequency output changing means for controlling the amount of electrons emitted from the electron emitting member, having a means to make the gate voltage variable to control the amount of electrons emitted from the cold cathode emitter used as an electron emitting source, or having a means to divide the electron emitting source into two or more sections.

Further aspect of the present invention relates to a microwave oven for dielectric-heating a substance to be heated using the foregoing novel magnetron as a source of microwave supply. More specifically there is provided a microwave oven for dielectric-heating a substance to be heated, the substance being placed in a heating room of the oven with microwave generated by a microwave supply source, characterized in that the microwave supply source is a magnetron including a cold cathode having an electron emitting member for emitting electrons, a subdivided anode which is disposed oppositely in parallel with the electron emitting member and which has cavity resonators formed therein at the side of the cold cathode, and a magnet which produces a magnetic field-lying at right angles to an electric field applied between the cold cathode and the subdivided anode.

In the microwave oven provided by the present invention there is employed a magnetron utilizing the filed-emission cold cathode of the invention as a microwave supply source. No filament is thus required that is essential for the conventional magnetrons using hot cathode. Accordingly, the resultant current density becomes significantly high, permitting size reduction of the magnetron.

Further, the microwave oven provided by the present invention preferably has a gate electrode formed between the cold cathode and the subdivided anode of the magnetron and a means for changing microwave output by changing a gate voltage applied to the gate electrode. Further, it is preferable that the microwave oven provided by the present invention have a means for detecting the temperature of the magnetron. In this configuration, the microwave output changing means controls the gate voltage to lower the microwave output when the temperature of the magnetron detected by the temperature detecting means goes over a predetermined value.

As mentioned above, in the microwave oven provided by the present invention, the electric field existing around a cathode surface can be changed by controlling the voltage applied to the gate electrode of the magnetron. Therefore, the amount of electrons emitted from the cathode, or the output of the microwave oven can readily be controlled, and an excessive temperature increase of the magnetron can be prevented.

Further, in the microwave oven provided by the present invention, the magnetron is equipped to a heating room housing while the electrode of the magnetron is electrically insulated against the housing, whereby a direct current power source which is not electrically insulated against a commercial power source can be served as the supply power source of the magnetron. Because of this, in the magnetron of the invention operation voltage can be reduced to as low as approximately 100 V. Accordingly, the magnetron in question can be easily equipped to the heating room housing electrically insulated against the electrode of the magnetron, permitting elimination of insulation with a primary circuit of the commercial power source.

Moreover, in the microwave oven provided by the present invention, it is preferable that a plurality of the magnetrons is disposed on the heating room housing, and in this case the microwave oven has a controlling means for operating each of the plurality of the magnetrons at the same time and controlling the microwave output from each magnetron independently. In this event, the magnetron provided by the present invention has a very small current flowing through the gate electrode relative to the anode current. It is thus possible to reduce the size of the power source supplying for the gate that is used to control the microwave output. In the event of operating a plurality of magnetrons at the same time, as in the case of the above-mentioned microwave oven, by independently giving only gate voltage of each magnetron, the system can be simplified while driving power source of the anode is common, which has a large capacity of an electric current.

The microwave oven provided by the present invention may have shape recognizing means for recognizing shapes of substances to be heated in the heating room and the controlling means may adjust a ratio of microwave outputs for the respective magnetrons depending on the shapes of the substances to be heated recognized by the shape recognizing means. Therefore, in a microwave oven having a plurality of the magnetrons, the output of each magnetron is supplied distributively in the heating room. Cross-sectional areas of substances to be heated are calculated by recognizing the shapes of the substances, for example, an optical means from the perspective by the image sensor of each power supplying port to adjust the output of each magnetron depending on the rate of the respective cross-sectional area, thereby equalizing the amount of a direct wave irradiated from the magnetron to the substance to be heated per unit area.

In general, microwave irradiation generated by a magnetron reaches a substance to be heated as either a direct wave or a reflected wave from the walls of a heating room. Since the reflected waves are attenuated with some losses on the walls, heating efficiency is more increased with a higher ratio of the direct waves. Therefore, microwave heating can be achieved at a high efficiency with less or no distribution and variation of heating by controlling the output of each magnetron to irradiate uniformly the direct waves to the surface of the substance to be heated as in the above-mentioned microwave oven.

Figure 2:
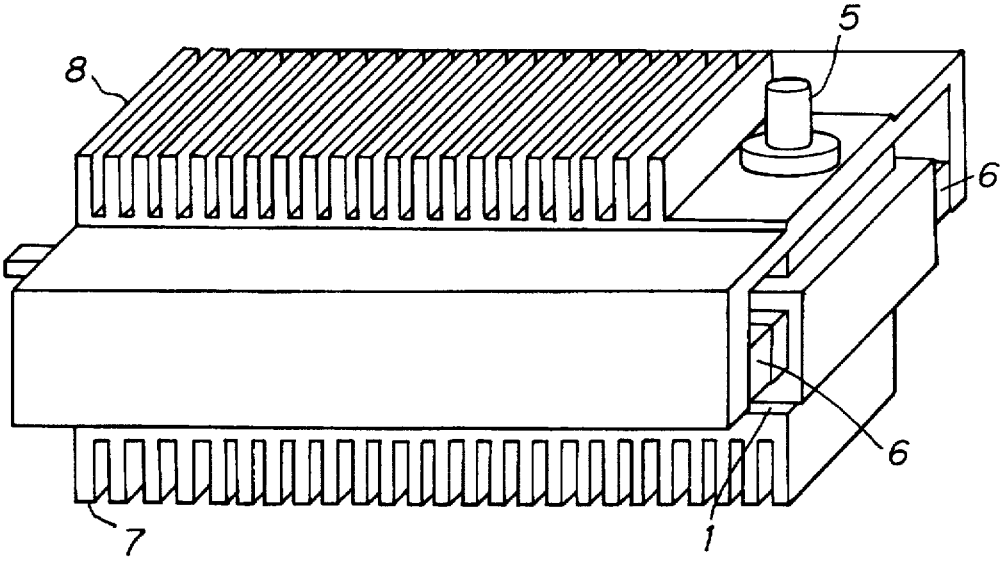
FIG. 2 is a perspective view showing an embodiment of a magnetron provided by the present invention.
Figure 3:
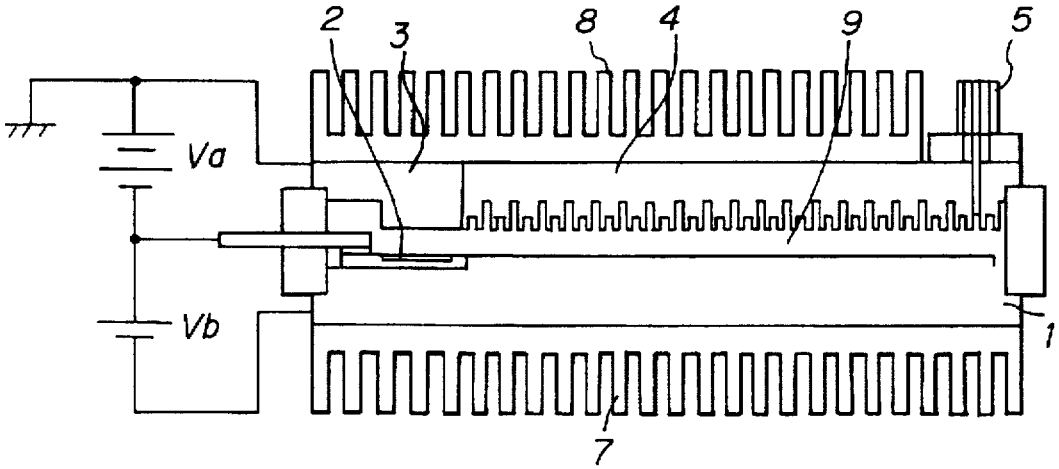
FIG. 3 is a cross-sectional side view of the magnetron illustrated in FIG. 2.

A magnetron of the present invention is described referring to the drawings. FIGS. 2 and 3 are outer perspective view and side cross-sectional view, respectively, showing an embodiment of a magnetron provided by the present invention.

Figure 4A:
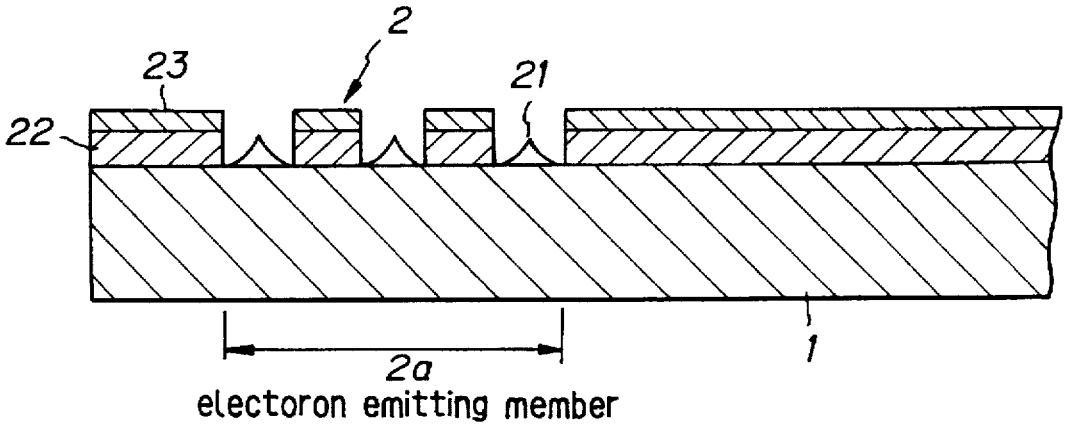
FIG. 4A is a schematic cross-sectional view showing an embodiment of a cold cathode illustrated in FIG. 3.
Figure 4B:
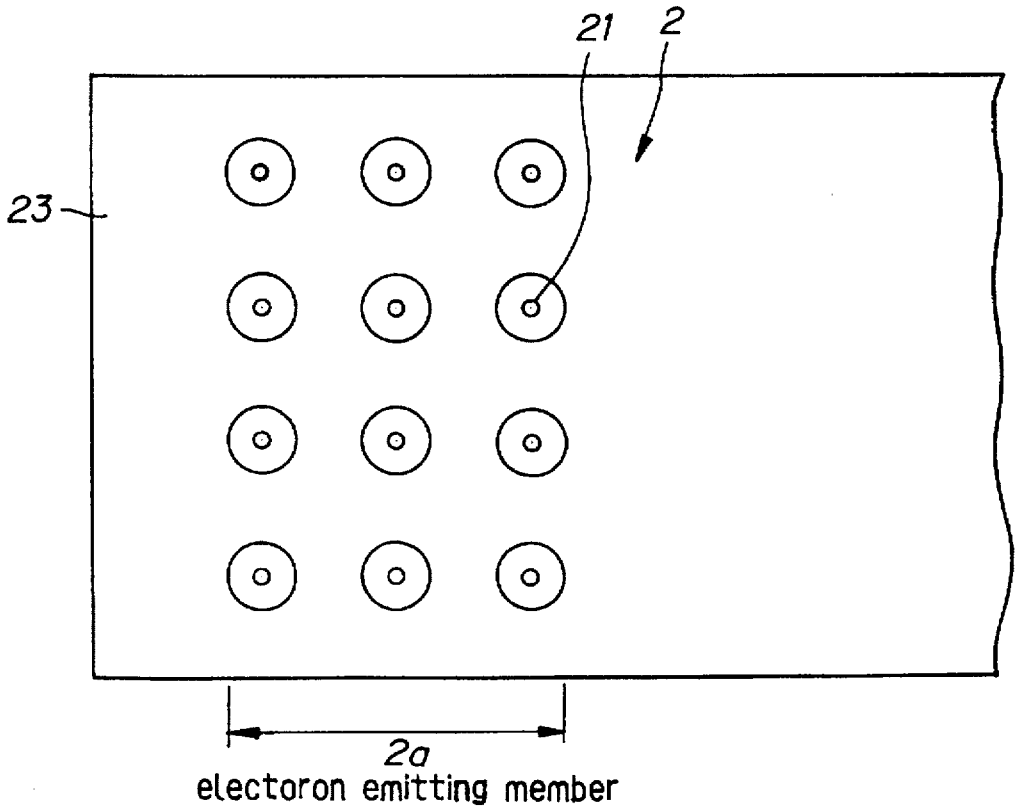
FIG. 4B is a schematic plane view showing the embodiment of the cold cathode illustrated in FIG. 3.

FIG. 4A is a schematic cross-sectional view showing an embodiment of a cold cathode shown in FIG. 3, and FIG. 4B is a schematic plane view showing the embodiment of the cold cathode shown in FIG. 3. In a magnetron of this present invention, a cold cathode 2 having an electron emitting member 2*a* for emitting electrons is formed on the inner surface (upper part in the figure) of a flat substrate 1, and an accelerating anode 3 is disposed at a certain distance from the inner surface to apply a high electric field to the electron emitting member 2*a*.

A subdivided anode 4 is adjacent to the accelerating anode 3 and is disposed at a certain distance from the inner surface of the substrate 1. More specifically, the subdivided anode 4 is disposed oppositely in parallel with the electron emitting member 2*a* of the cold cathode 2 formed on the inner surface of the substrate 1. A portion of cavity resonators is formed in the side of this subdivided anode 4 facing to the cold cathode 2. An output member 5 is provided on the subdivided anode 4 at the right edge thereof to extract a high frequency power to outside. A magnet 6 is disposed over entire interaction space for electrons. The magnet 6 provides a magnetic field lying at right angles to an electric field applied between the cold cathode 2 and the subdivided anode 4. A heat-radiating plate 7 is disposed on the outer surface (lower part in the figure) of the substrate 1 while a heat-radiating plate 8 is disposed on outer surfaces (upper part in the figure) of the anodes 3 and 4.

Direct current DC power sources Va and Vb are connected in series between the substrate 1 and the anodes 3, 4. Further, connection midpoint between the DC power sources Va and Vb is connected to a gate 23, which will be described later, of the electron emitting member 2a. In this embodiment, an anode terminal of the DC power source Va connected to the accelerating anode 3 reaches the ground, so that the cold cathode 2 and the substrate 1 have minus electric potential.

In this embodiment, as shown in FIG. 4, the electron emitting member 2a is composed of field-emission cold cathode arrays. More specifically, many fine needles are formed as emitters (sources of electrons) 21 on the substrate 1. The gate 23 is formed near the emitters 21 through an insulation layer 22 for facilitating the emission of the electrons. While only twelve (three by four) emitters 21 are shown in the figure, a large number of emitters 21 is formed in practice. As apparent from FIG. 4, this embodiment has thus been described in conjunction with the electron emitting member 2a formed as a plane (in two dimensions) on the substrate 1. However, the electron emitting member 2a may be linearly formed on substrate 1 by means of making, for example, four (one by four) emitters 21.

Figure 5:
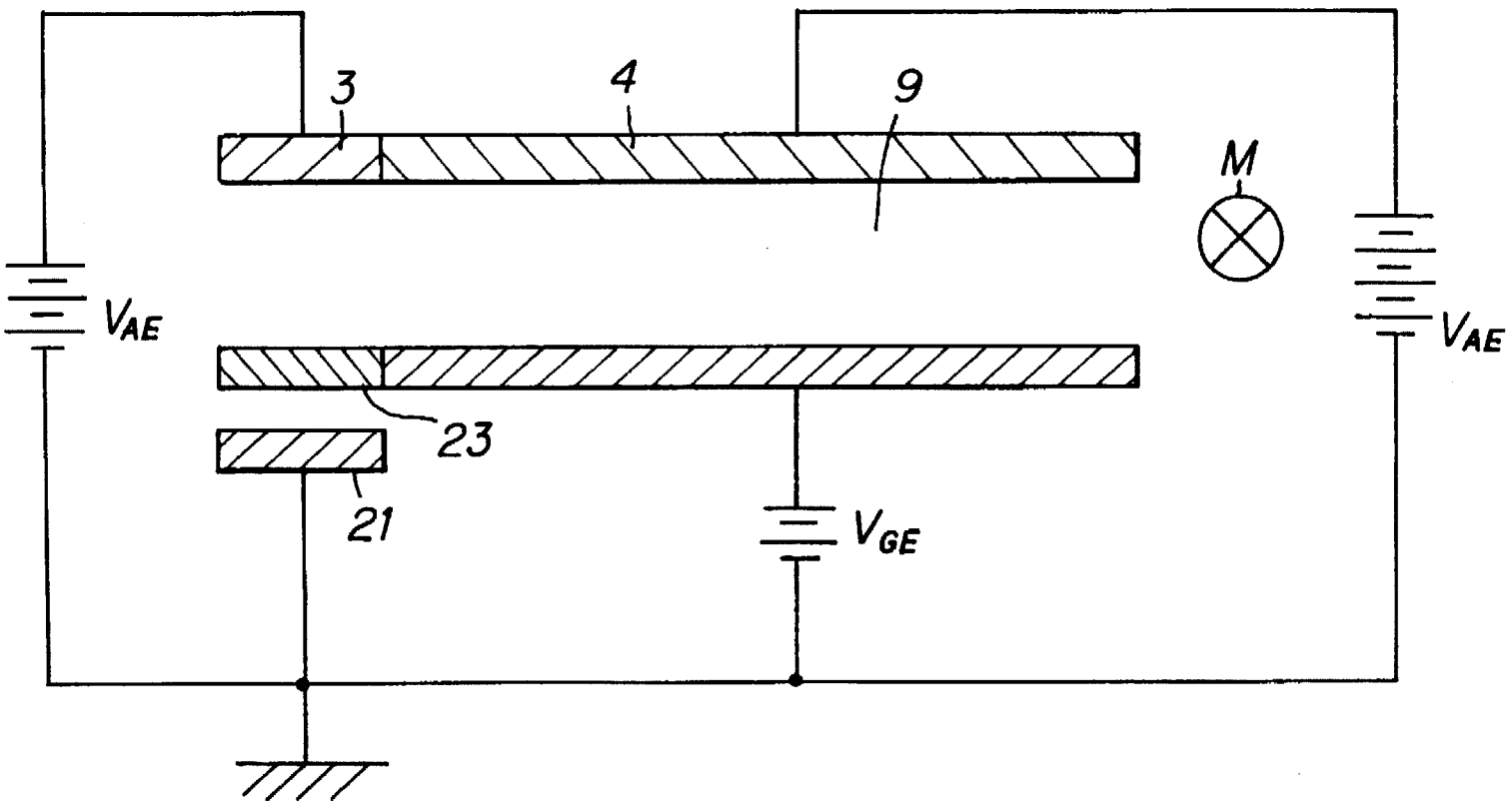
FIG. 5 is an illustrative view showing electric potential state of the magnetron provided by the present invention.

Next, operation will be described. FIG. 5 shows an electric potential state applied to individual electrodes. Electrons emitted from the emitter 21 of the electron emitting member 2a are turned toward the right direction in the figure due to a magnetic field M applied by the magnet 6, and are led to the portion of cavity resonators in which the subdivided anode 4 is present. The electrons are given bunching effect in an interaction space 9 of the resonating portion due to the act of the electric field and the magnetic field, which move to the right direction in the figure while extracting a high frequency energy.

The electrons which have given out the potential energy through the output member 5 as the high frequency energy, in which the potential energy received by the applied voltage, are successively absorbed by the subdivided anode 4. Therefore, in order to achieve a high efficiency of converting the input energy into a high frequency output energy, the subdivided anode 4 is required to have an enough length, relative to the moving direction of electrons, to allow all electrons emitted from the emitters 21 to reach the subdivided anode 4.

An exemplified magnetron obtained according to this embodiment provides a high-frequency output of at least 500 W at the oscillating frequency of 2.4 GHz when the length of the subdivided anode 4 is 120 mm relative to the moving direction of the electrons, the anode-dividing pitch of the subdivided anode 4 is 1.5 mm, the distance between the anode and the cathode is 1.2 mm, the area of the electron emitting member 2a is 0.4 $cm^2$, the emitter pitch is 5 μm the anode voltage is 1.5 kV, the gate voltage is 300 V, and the applied magnetic field is 1,800 gauss.

Next, another embodiment of the electron emitting member will be described. The above-mentioned structure of the electron emitting member 2a is the field-emission cold cathode array that is so-called Spindt-type or Gray-type. In the cold cathode of the type described, the distance between the tip of the emitter and the gate edge is equal to an expansion at the emitter bottom, called cone, typically approximately 1 μm. The typical operating voltage ranges thus from several hundreds to several thousands volts. Considering this, if the distance between the emitter tip and the gate edge can be shortened, the operating voltage can be reduced.

Figure 6A:
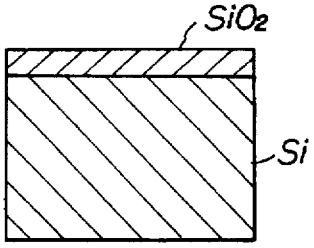
FIGS. 6A–F are cross sectional views showing a manufacturing process of another embodiment of an electron emitting member.
Figure 6D:
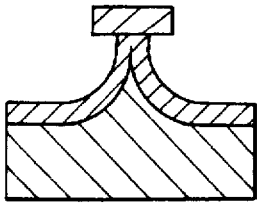
Figure 6B:
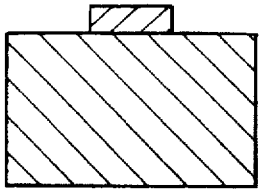
Figure 6E:
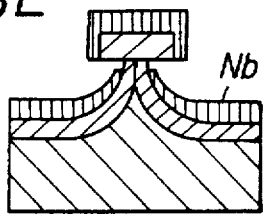
Figure 6C:
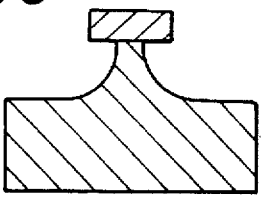

FIGS. 6A–F are cross-sectional views showing a process of manufacturing such electron emitting member. First, an n-type <100> silicon wafer Si having the resistivity of 1 Ω-cm is heat-oxidized at 1,000° C. to form a heat-oxidized film $SiO_2$ with the film thickness of 300 nm (FIG. 6A). Next, by using photolithography technology, a mask which is made up of $SiO_2$ circles having the diameter of 3 μm is formed (FIG. 6B), and then an emitter base is formed by dry-etching the silicon (FIG. 6C).

Figure 6F:
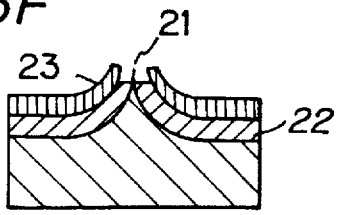

Next, the resultant assembly is heat-oxidized up to a thickness of 400 nm to form an insulating layer 22 and at the same time to sharpen the emitter 21 (FIG. 6D), following which deposition is carried out obliquely to form a gate electrode layer 23 (FIG. 6E). The emitter 21 is then exposed by etching $SiO_2$ mask (FIG. 6F). This series of processes permitted to reduce the distance between the tip of the emitter 21 and the edge of the gate 23 to 0.4 μm or shorter. In accordance with this manufacturing process, the above-mentioned flat magnetron with the shape shown in FIGS. 2 and 3 was produced by using the cold cathode array as the cathode, which was integrated at the emitter pitch of 5 μm on the silicon substrate of 3.5 $cm^2$ in area.

An exemplified magnetron obtained according to this embodiment provides a high frequency output of at least 500 W at the oscillating frequency of 2.4 GHz when the length of the subdivided anode 4 is 40 mm relative to the moving direction of the electrons, the anode-dividing pitch of the subdivided anode 4 is 0.4 mm, the distance between the anode and the cathode is 0.3 mm, anode voltage is 100 V, gate voltage is 25 V, applied magnetic field is 1,800 gauss. In this way, the smaller magnetron driven at a lower voltage was obtained in comparison with the magnetron obtained in the foregoing embodiment.

While this embodiment has thus been described in conjunction with the structure having the emitters and the gate arranged closely to each other with the heat-oxidized film served as the insulating layer to reduce the operating voltage, a means to reduce the operating voltage is not limited thereto. In order to reduce the operating voltage, for example, the emitter may be disposed at a closer position to the gate with a sacrificed layer by means of narrowing a diameter of the gate aperture in the Spindt-type cold cathode. Alternatively, the radius of curvature at the tip of the emitter may be reduced significantly by means of anodic etching. Any one of appropriate method may be used as long as it allows reduction of the operating voltage.

The specific values used in each steps of this production process are not just limited to the foregoing values, especially the applied voltage is not limited to 100 V. Instead, these values should be determined such that the resultant magnetron is suitable to the commercial voltages used in the area where it is used.

Next, yet another embodiment of the electron emitting member is described. Because a portion of the electrons emitted from the above-mentioned electron emitting member 2a is incident upon the gate electrode after being displaced by the magnetic field, an electric current flows through the gate electrode. The current flown through the gate electrode can be reduced when the length of the electron emitting member 2a, relative to the moving direction of the electrons emitted from the electron emitting member 2a, is defined to be "$2\pi mE/eB^2$" or shorter, ($\pi$ is the ratio of the circumference of a circle to its diameter, m is an electron mass, E is an applied voltage, e is an amount of elemental electricity, B is a magnetic field). The length of the electron emitting member 2a relative to the moving direction of the electrons is, in the event of the field-emission cold cathode array of, for example, the Spindt-type as illustrated in FIG. 4A, is defined to be the length of the gate electrode 23 formed between the left edge of the bottom of the left most emitter 21 to the right edge of the bottom of the right most emitter 21.

An exemplified magnetron obtained according to this embodiment provides an oscillating frequency of 2.4 GHz, a high-frequency output of at least 3.5 W, and the gate current of 70 μA or smaller, when the length of the electron emitting member 2a is 0.15 mm, the emitter pitch is 5 μm, the length of the subdivided anode 4 relative to the moving direction of the electrons is 40 mm, the anode dividing pitch of the subdivided anode 4 is 0.4 mm, and the distance between the anode and the cathode is 0.3 mm, for the electron emitting member 2a produced provided by the process illustrated in FIG. 6, and when the anode voltage is 100 V, the gate voltage is 25 V, and the magnetic field applied is 180 gauss.

Here is described the reason to define the length of the electron emitting member 2a relative to the electron moving direction to be "$2\pi mE/eB^2$". The force interacted on the electrons moving in the static magnetic field, is given by the product of the velocity component u of the electrons which is at right angles to the magnetic field and the magnetic field B. This force does not affect the component parallel to the magnetic field B. In the field where the static electric field E and the static magnetic field B exist, the equation of motion of the electrons is given in the rectangular coordinates (x, y, z) as follows:

$$\frac{d^2x}{dt^2} = \eta\{E_x + (u_yB_z - u_zB_y)\} \tag{1}$$

$$\frac{d^2y}{dt^2} = \eta\{E_y + (u_zB_x - u_xB_z)\}$$

$$\frac{d^2z}{dt^2} = \eta\{E_z + (u_xB_y - u_yB_x)\}$$

wherein, $\eta = e/m$.

Figure 7A:
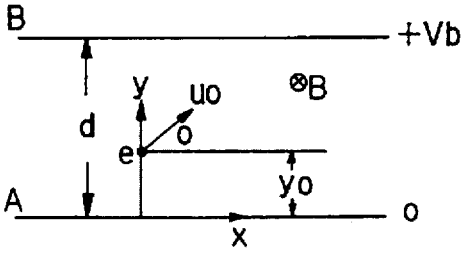
FIG. 7A is a view showing an electron state at the initial instant in a crossed electric and magnetic fields.

Now, as shown in FIG. 7A, it is assumed that the accelerating voltage Vb is applied to the span having the distance d between the parallel flat electrodes, and that the magnetic flux density B is applied in parallel with the surface of the electrodes, the equation of motion of an electron emitted from an arbitrary point at an arbitrary initial velocity is given for each component from the equation (1) as follows:

$$\frac{d^2x}{dt^2} = -\eta B\frac{dy}{dt} \tag{2}$$

$$\frac{d^2y}{dt^2} = -\eta E + \eta B\frac{dx}{dt}$$

In this event, it is assumed that the initial conditions are as follows: $t=0$, $y=y_0$, $(dx/dt)=u_0\cdot\cos\theta$, $(dy/dt)=u_0\cdot\sin\theta$. Then, the equation (2) can be as follows:

$$x = \bar{u}t + \frac{\eta|E}{\omega c^2}\sqrt{1+\left(\frac{u_0}{\bar{u}}\right)^2 - 2\left(\frac{u_0}{\bar{u}}\right)\cos\theta}\ \{\cos(\omega_c t+\alpha) - \cos\alpha\} \tag{3}$$

$$y = y_0 + \frac{\eta|E}{\omega c^2}\left\{1 - \frac{u_0}{\bar{u}}\cos\theta - \sqrt{1+\left(\frac{u_0}{\bar{u}}\right)^2 - 2\frac{u_0}{\bar{u}}\cos\theta}\ \sin(\omega_c t+\alpha)\right\}$$

wherein, $\bar{u} = \frac{E}{B}$ $$\alpha = \sin^{-1}\frac{1-\frac{u_0}{\bar{u}}\cos\theta}{\sqrt{1+\left(\frac{u_0}{\bar{u}}\right)^2 - 2\frac{u_0}{\bar{u}}\cos\theta}}$$

$$\omega_c = \eta|B$$

and $\omega_c$ is cyclotron angular frequency.

Figure 7B:
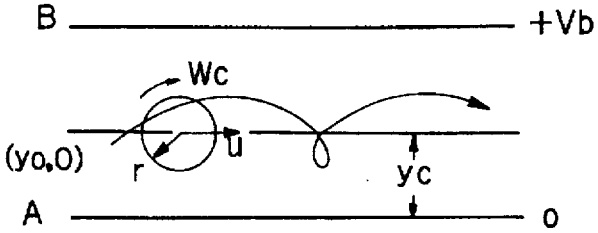
FIG. 7B is a view showing a trochoid orbit along which electrons move.

Therefore, the electrons move at the angular velocity $\omega_c$ along a circle having a radius of $$\gamma = \frac{\eta|E}{\omega c^2}\sqrt{1+\left(\frac{u_0}{\bar{u}}\right)^2 - 2\frac{u_0}{\bar{u}}\cos\theta} \tag{4}$$

with the center thereof defined along the line $$y_c = y_0 + \frac{\eta|E}{\omega c^2}\left(1 - \frac{u_0}{\bar{u}}\cos\theta\right) \tag{5}$$

at the velocity (E/B). Orbit like this is referred to as trochoid, which is the same as the orbit of a point on a circular plate when such a circular plate linearly moves with rotation. FIG. 7B shows trochoidal orbit of electrons.

Based on the equation (3), the distance L of over which the electrons move during the duration between a certain time instant $t_0$ and the time $t_1$ ($=t_0+2\pi/\omega c$) corresponding to one cycle of the cyclotron is as follows:

$$L = x(t_1) - x(t_0) = \bar{u}(t_1 - t_0) = \frac{2\pi mE}{eB^2} \tag{6}$$

Therefore, the distance L over which the electrons move during one cycle is $L=2\pi mE/eB^2$. Electrons emitted at the position away from the sole at a distance L or longer enter into the gate electrodes, while electrons emitted at the position within the distance L from the sole move the interaction space between the sole and the anode without entering into the gate electrode.

Figure 8:
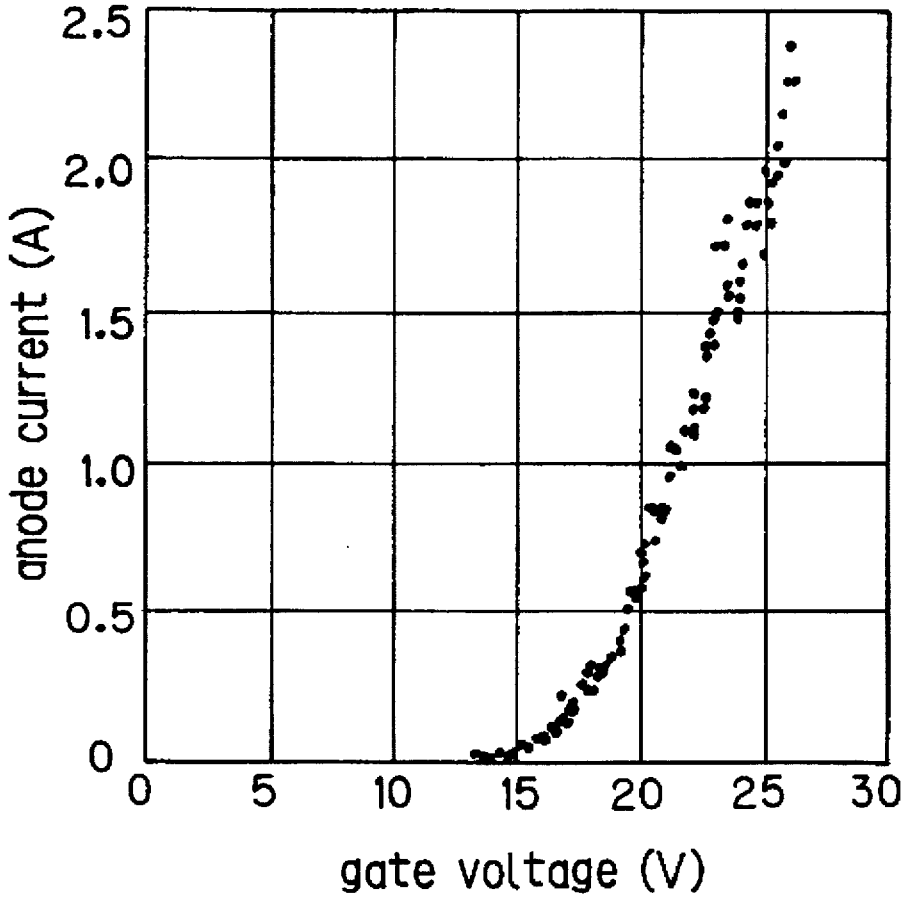
FIG. 8 is a graphical representation showing a characteristic curve of the electron emitting member manufactured through the process shown in FIG. 6.

The graph in FIG. 8 shows the anode current as a function of the gate voltage per one emitter of the electron emitting member 2a which is produced according to the manufacturing process shown in FIG. 6. The anode voltage is fixed at 100 V. As clear from this graph, it is observed that the electron emission begins at the gate voltage of 15 V or lower. The anode current is sequentially increased as the gate voltage increases, and the anode current was 0.2 μA at the gate voltage of 17 V, while the anode current was 2.0 μA, 10 times as large as above, at the gate voltage of 25 V.

Based on these observed result, the gate voltage circuit is made to be a circuit in which voltage is continuously variable to achieve a magnetron whose output is variable. In the circuit shown in FIG. 5, the gate voltage $V_{GE}$ is made to be continuously variable from 15 V to 30 V with a simple structure using a typical potentiometer.

In the magnetron having the above structure, the high frequency output was measured with changing the gate voltage $V_{GE}$. As a result, a high frequency output of at least 500 W at the gate voltage of 25 V and at least 50 W at the gate voltage of 17 V were obtained in proportion to the anode current, as expected from the above-mentioned anode current-gate voltage characteristics in FIG. 8. Further, it was confirmed that the high frequency output became continuously variable at the gate voltage of between 25 V and 17 V.

While the field-emission electron source having the above-mentioned current-voltage characteristics is used in this embodiment, an electron source with different current-voltage characteristics may equally be used. Alternatively, any other electron source of a cold cathode may be used rather than the field-emission cold cathode. Although a potentiometer is used to vary the gate voltage continuously, any voltage variable circuits may also be used as long as a circuit has an output impedance lower than the impedance at the gate input. Further, it is needless to say that the range of the gate voltage to be varied should be selected such that it matches the range of the desired high frequency output.

Figure 9:
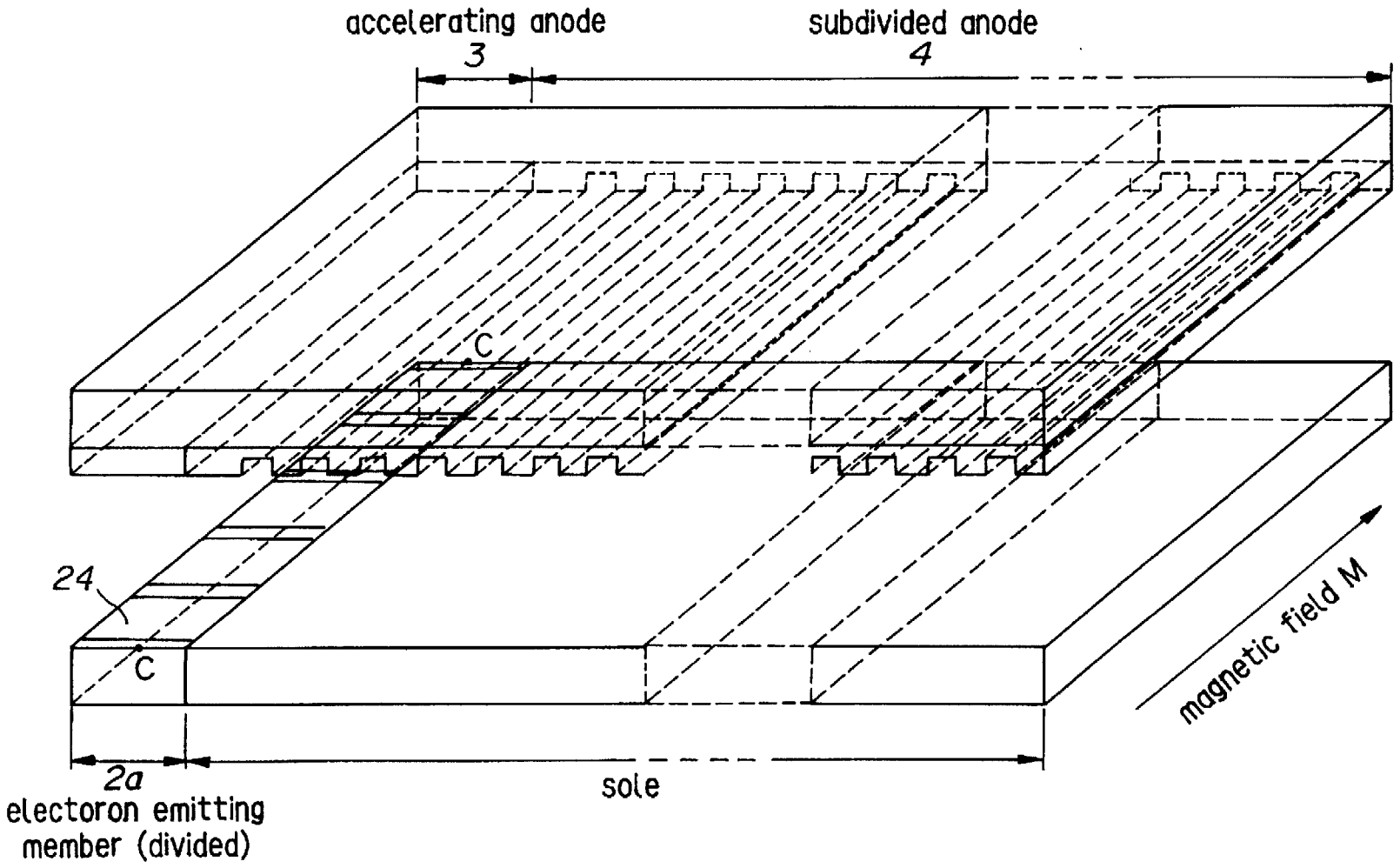
FIG. 9 is a perspective view showing another embodiment of a magnetron provided by the present invention.
Figure 10:
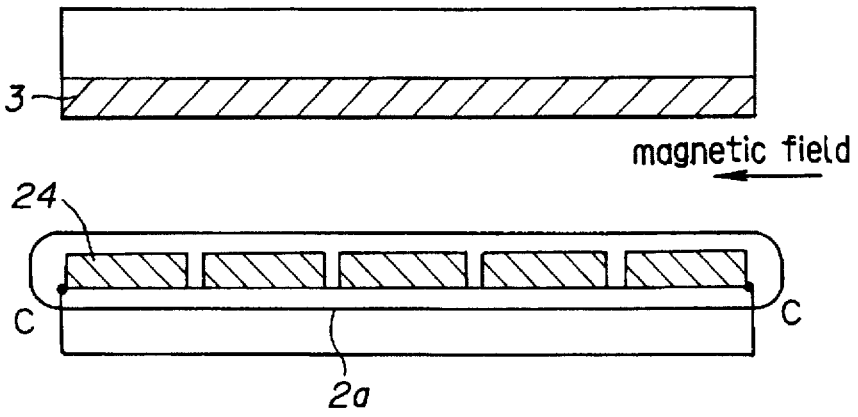
FIG. 10 is a cross-sectional view taken along the line C—C in FIG. 9.

Further, there is provided another embodiment of the magnetron according to the present invention. In the magnetron according to the present embodiment, the electron emitting member 2a is divided into two or more sections, which are controlled independently to achieve variable high frequency output. FIG. 9 is a perspective view showing the structure of a magnetron according to this embodiment. FIG. 10 is a cross-sectional view taken along the line C—C in FIG. 9.

Figure 11:
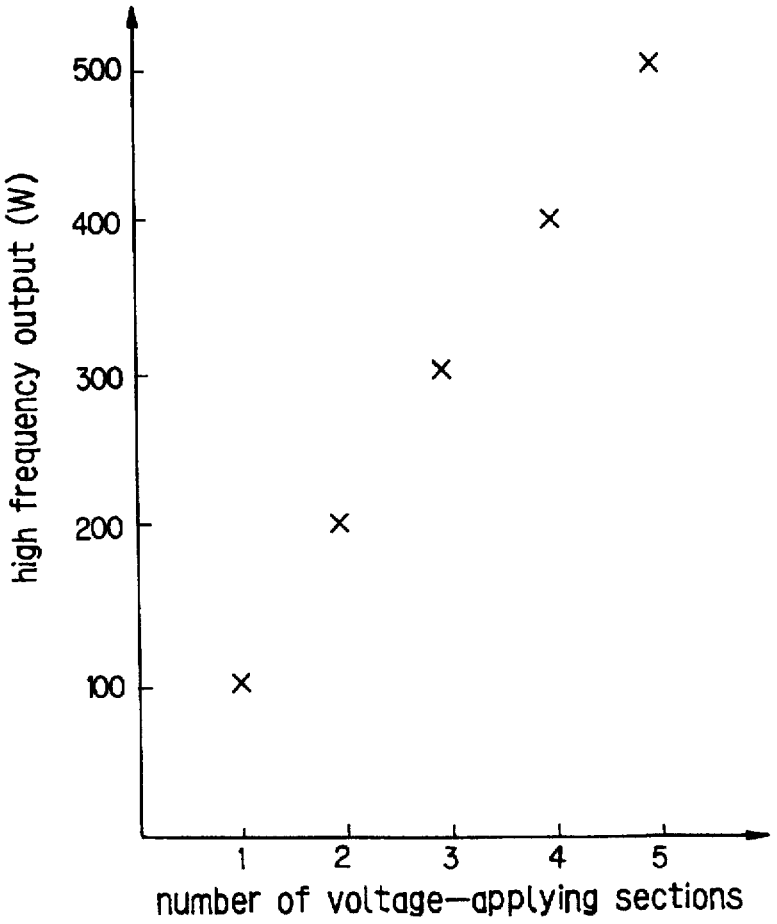
FIG. 11 is a graphical representation showing relationship between the number of voltage applied sections of the electron emitting member and the high frequency output of the magnetron illustrated in FIG. 9.

In this embodiment, an electron emitting member 2a is divided into 5 sections. As a specific method of dividing the electron emitting member 2a, the gate electrode 24 is equally divided into 5 sections. FIG. 11 shows a change in the high frequency output caused by changing the amount of electrons emitted in the selected number of five sections to which the voltage is applied. The result shows that a high frequency output is obtained in proportion to the number of sections where the voltage is applied.

While in this embodiment the electron emitting member 2a is divided by means of dividing the gate electrode the dividing method is not just limited thereto and any one of other methods may be used, for example, dividing the emitter electrode or dividing the anode electrode. It is needless to say that the number of division is not just limited to five, and equal division is not essential.

Next, yet another embodiment of a magnetron according to the present invention is described. While the above-mentioned magnetron in each of the foregoing embodiments has the cathode of the plain structure, the magnetron according to this embodiment has the same concentric cylindrical shape as conventional magnetrons have. More specifically, the above mentioned cathode 62 in FIG. 1 is composed of a cylindrical cathode of the field-emission cold cathode. It is preferable that the distribution of the magnitude of the magnetic field in the direction of the cathode axis in an interaction space 63 adjacent to the edge oppositely facing to vane 61 is defined to be within ±10% of its average value.

The field-emission cold cathode array in the present embodiment is formed as follows. A resist layer is provided, in which circular holes each having a diameter of approximately 1 μm are formed at several μm pitch by means of the electron beam lithography, on a metal cylinder of, for example, W, Ni, Al and the like following which a metal such as W, Ni, Nb is deposited thereon in a vacuum deposition device, thereby to form many needles referred to as cones. After continuing the deposition until the holes in the resist are completely sealed with the deposition metal, the metal cylinder is taken out from the deposition device and is used as the cathode of a magnetron.

An exemplified magnetron obtained according to this embodiment provides a high-frequency output of at least 500 W at the oscillating frequency of 2.4 GHz, when the cathode radius is 1.5 mm, the anode radius is 3.8 mm, the length of the cathode in the axial direction is 7 mm, the number of subdivided anode sections is eight, the emitter pitch is 5 μm, the anode voltage is 4 kV, and the magnetic field applied is 1,800 gauss.

While the magnetrons in the foregoing embodiments use the field-emission cold cathode array as the electron emitting member, the electron emitting member is not just limited thereto, and a cold cathode using the tunnel effect, pin junction, the electron avalanche effect and the like may be used. The gate is formed on the electron emitting member in order to facilitate emission of the electrons. However, the gate is not essential and may be replaced with a single emitter. Further, it is needless to say that the dimension and size of the configuration, the applied voltage, the applied magnetic field, the oscillating frequency, the output, etc. are not limited just to the foregoing values.

Figure 12:
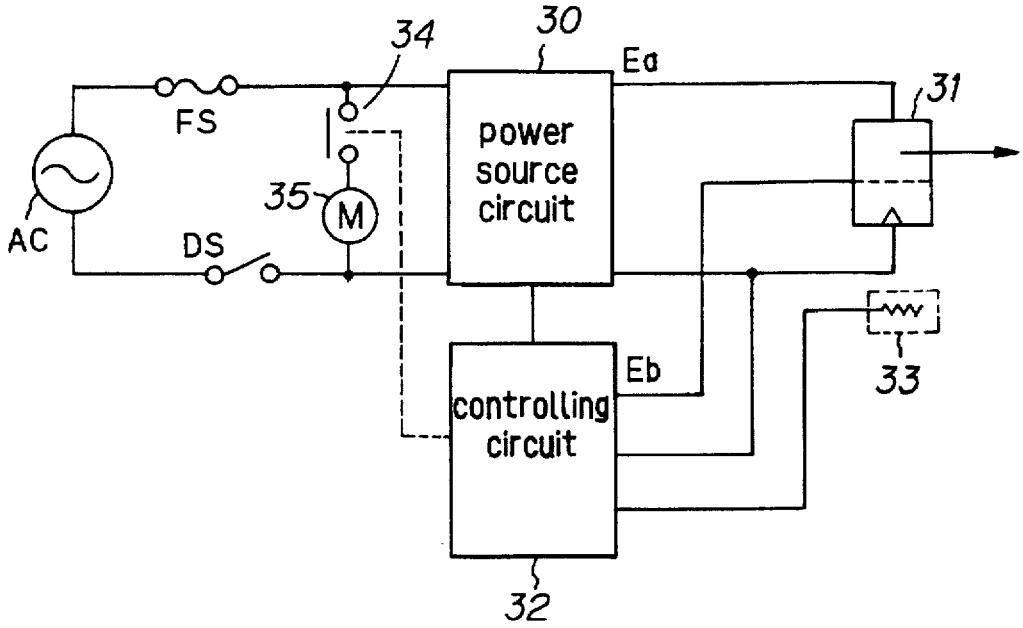
FIG. 12 is a block diagram showing an embodiment of a microwave oven provided by the present invention.
Figure 13:
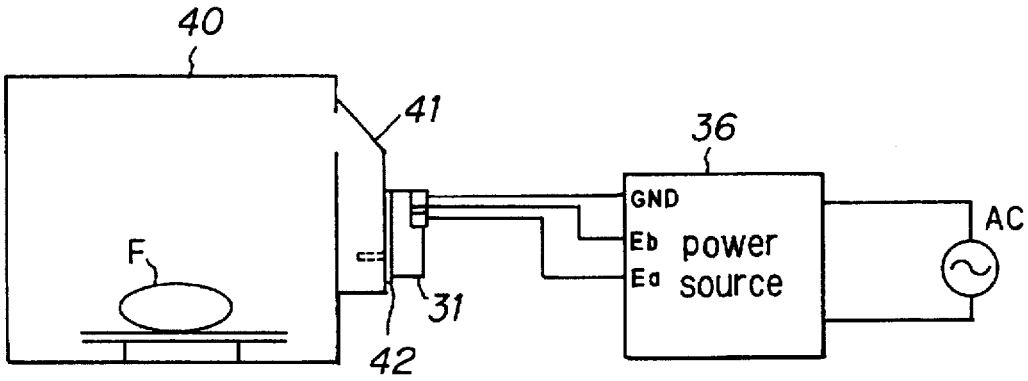
FIG. 13 is a view showing a magnetron attached to a microwave oven provided by the present invention.

Next, a microwave oven provided by the present invention is described, in which the above-mentioned magnetron of the present invention is used as a microwave supply source. FIG. 12 is a block diagram showing an embodiment of a microwave oven provided by the present invention. A power source circuit 30 converts commercial alternating current power source (AC) supplied through a fuse FS and a door switch DS into direct current (DC) voltage, and supplies it to the area between the anode and the cathode of a magnetron 31 as an anode voltage Ea.

A controlling circuit 32 receiving the DC voltage from the power source circuit 30 controls the gate voltage Eb of the magnetron 31 and adjusts the oscillating output thereof. The controlling circuit 32 detects the temperature of the magnetron 31 through a temperature sensor 33 disposed near the magnetron 31. When the temperature of the magnetron 31 increases excessively, the controlling circuit 32 adjusts the gate voltage Eb to restrict the input voltage of the magnetron 31. Further, the controlling circuit 32 controls a relay contact 34 with on/off to control the AC power source supplied to a cooling fan motor 35.

When the size of the magnetron as a microwave supply source is large as in a conventional microwave oven, the magnetron is required to be incorporated into the heating room housing by means of electrically connecting the anode of the magnetron with the heating room housing. In this case, the conventional microwave oven is needed to be separated from the commercial power source to avoid getting an electric shock due to the high power source voltage of the magnetron, which requires an insulation transformer.

With this respect, the present invention ensures insulation with an insulating material 42, even though the power source 36 which is not insulated with a commercial AC power source, is used, taking a step in which the magnetron 31 is attached to a waveguide tube 41 of the heating room housing 40 through the insulating material 42. This permits the power source 36 to have a simple circuit structure without using an insulation transformer. The power source 36 includes the fuse FS, the door switch DS, the power source circuit 30 and the controlling circuit 32.

Figure 14:
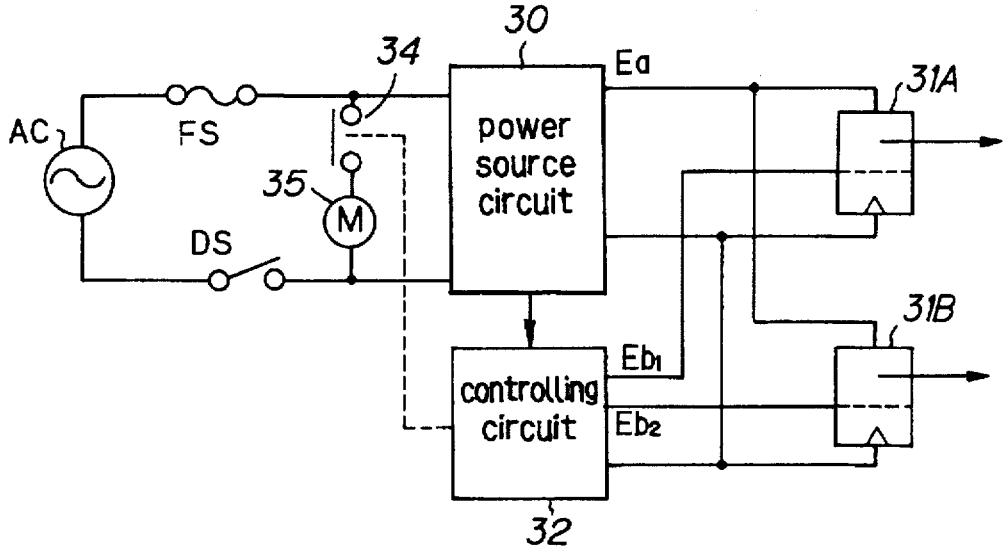
FIG. 14 is a block diagram showing another embodiment of a microwave oven provided by the present invention.

Next, another embodiment of the microwave oven in the present invention is described. FIG. 14 is a block diagram showing another embodiment of a microwave oven according to the present invention. This embodiment is for the case where two magnetrons 31A, 31B are operated in parallel. The gate voltages Eb1, Eb2 are applied independently to the magnetrons 31A, 31B, respectively with a common anode voltage Ea also applied thereto. The magnetrons 31A, 31B are controlled in a variable manner independently of each other. Other configurations are the same as those of the foregoing FIG. 12.

Figure 15:
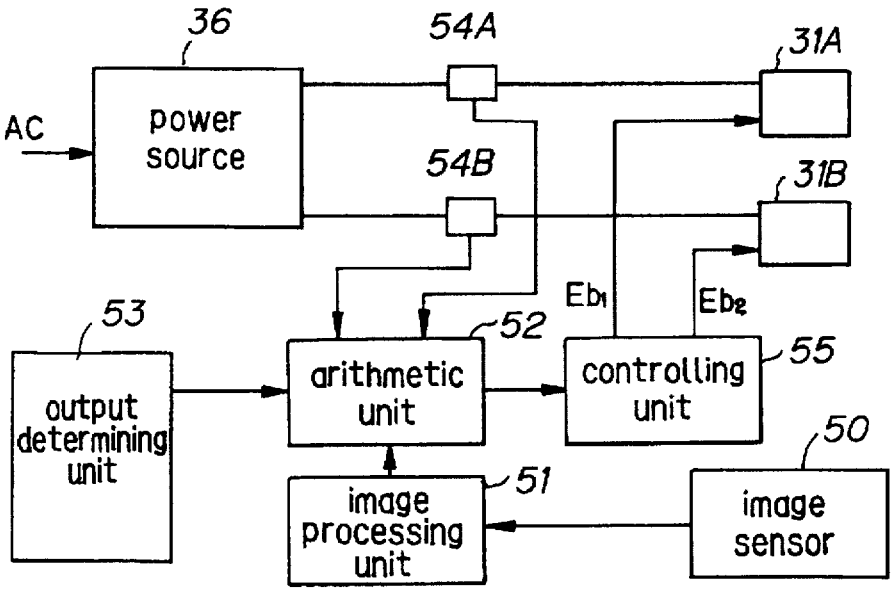
FIG. 15 is a block diagram showing a modification of the microwave oven shown in FIG. 14.

For the embodiment where two magnetrons 31A, 31B are operated in parallel, FIG. 15 shows that the cross-sectional area of a substance F to be heated, from the perspective of the power supply source portion of the magnetrons 31A, 31B to the inside of the housing is determined by reading, through an image sensor 50, image information of the substance F to be heated in a heating room housing 40 and extracting the outline of the substance F to be heated in an image processing unit 51.

In an arithmetic unit 52, the outputs of the magnetrons 31A, 31B are determined based on a predetermined value of heating output from an output determining unit 53 and cross-sectional area information for the substance F obtained from the image processing unit 51. For example, letting the cross-sectional area from the perspective of the power supply source portion of the magnetron 31A be SA, the cross-sectional area from the perspective of the power supply source portion of the magnetron 31B be SB and the predetermined output value determined by the output determining unit 53 be PW, the output PA of the magnetron 31A is PA=PW×SA/(SA+SB), and the output PB of the magnetron 31B is PB=PW×SB/(SA+SB). Each of the predetermined output values PA, PB is controlled by means of adjusting the respective gate voltages Eb1, Eb2 supplied from a controlling unit 55 to the magnetrons 31A, 31B while monitoring current detection units 54A, 54B.

Figure 16A:
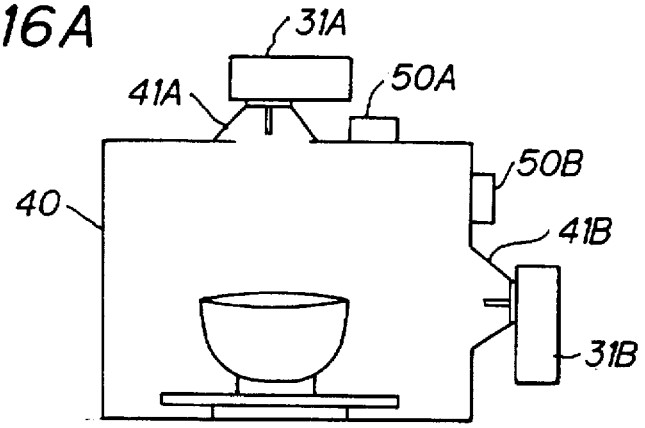
FIGS. 16A–C are views showing examples of use of a microwave oven with a plurality of magnetrons.
Figure 16B:
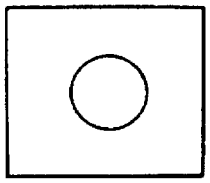
Figure 16C:
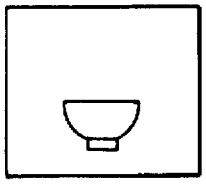

FIGS. 16A–C show an example of the use of a microwave oven with two magnetrons. FIG. 16A shows an example where the magnetron 31A is disposed on the upper surface of the heating room housing 40, and the magnetron 31B is disposed on the side thereof. The image sensor 50A is disposed on the upper surface of the heating room housing 40, and the image sensor 50B is disposed on the side thereof. Based on the image information as shown in FIGS. 16B and 16C for the substance F to be heated, obtained by the image sensors 50A, 50B, each cross-sectional area is obtained in the image processing unit.

Figure 17A:
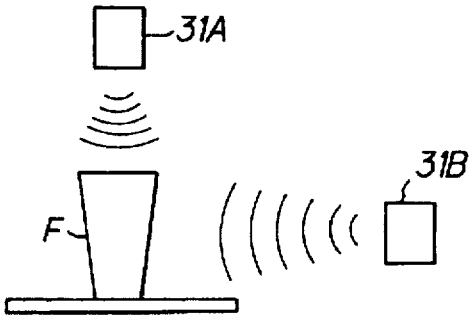
FIGS. 17A–C are views showing examples of use of a microwave oven with a plurality of magnetron.
Figure 17B:
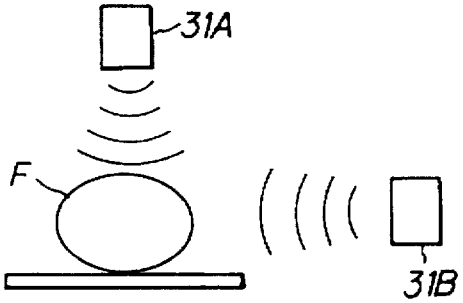
Figure 17C:
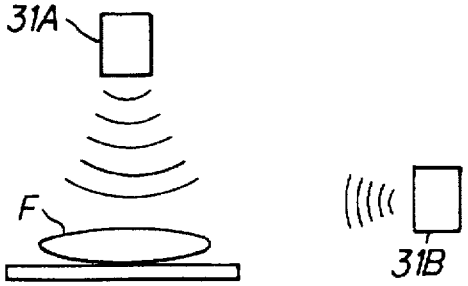

FIGS. 17A–C show a change in output distribution of the magnetrons 31A, 31B depending on the shape of a substance F to be heated. When the substance F to be heated, for example, is a food product placed in a deep vessel like a glass as shown in FIG. 17A, the output of the magnetron 31A disposed on the upper surface is decreased and the output of the magnetron 31B disposed on the side is increased.

On the other hand, when the substance F to be heated is a food product having an oval shape like an egg as shown in FIG. 17B, the outputs of the two magnetrons 31A, 31B is equalized. When the substance F to be heated is a food product having a flat shape-like a pizza as shown in FIG. 17C, the output of the magnetron 31A disposed on the upper surface is increased, while the output of the magnetron 31B disposed on the side is decreased. In this way, the microwave emission pattern which is most suitable for the substance F to be heated can be selected by controlling the output of the two magnetrons depending on the shape of the substance F to be heated.

While this embodiment has thus been described in conjunction with a case where two magnetrons are used for emitting the microwave from two directions, additional magnetrons may be disposed on the opposite side, the interior or the like, thereby providing more uniform heating. Further, while this embodiment shows an example that the output of the magnetron used as the source of oscillation is controlled by controlling the gate voltage, the output of the magnetron used as the source of oscillation may be controlled by means of a high frequency power source.

What is claimed is:

1. A magnetron, comprising:

a generally planar substrate;

a cold cathode having an electron emitting member for emitting electrons, said electron emitting member being formed in two coplanar dimensions on said substrate;

a subdivided anode which is disposed oppositely in parallel with the electron emitting member and which has cavity resonators formed therein at the side of the cold cathode; and a magnet producing a magnetic field lying at right angles to an electric field applied between the cold cathode and the subdivided anode, wherein the length of the electron emitting member is $2\pi mE/eB^2$ relative to the moving direction of the electrons emitted from the electron emitting member, wherein $\pi$ is the ratio of the circumference of a circle to its diameter, m is mass of an electron, E is an applied electric field, e is an amount of elementary electric charge, and B is a magnetic field.

2. The magnetron according to claim 1, further comprising a gate electrode formed between the cold cathode and the subdivided anode of the magnetron and means for changing microwave output power by varying a gate voltage applied to the gate electrode.

3. The magnetron according to claim 1, wherein the electron emitting member includes at least one section, and each section of the electron emitting member is composed of a field-emission cold cathode array.

4. A magnetron, comprising:

a generally planar substrate;

a cold cathode having an electron emitting member for emitting electrons, said electron emitting member being formed in two coplanar dimensions on said substrate;

a subdivided anode which is disposed oppositely in parallel with the electron emitting member and which has cavity resonators formed therein at the side of the cold cathode;

a magnet producing a magnetic field lying at right angles to an electric field applied between the cold cathode and the subdivided anode; and means for adjusting output power by adjusting the amount of electrons emitted from the electron emitting member.

5. The magnetron according to claim 4, further comprising a gate formed on the electron emitting member, and said means for adjusting varies a gate voltage applied to the gate to adjust the amount of electrons emitted from the electron emitting member.

6. The magnetron of claim 5, wherein said means for adjusting provides a continuously variable gate voltage.

7. The magnetron according to claim 4, wherein the electron emitting member is divided into two or more sections, and the sections of the electron emitting member are independently controlled by said means for adjusting to change their respective output powers.

8. The magnetron according to claim 7, wherein each section of the electron emitting member is composed of a field-emission cold cathode array.

9. The magnetron according to claim 7, wherein said subdivided anode is a single, uniform anode.

10. The magnetron of claim 7, wherein said means for adjusting provides a continously variable gate voltage.

11. The magnetron according to claim 4, wherein said electron emitting member includes a plurality of emitters disposed on said substrate.

12. The magnetron according to claim 11, further comprising a gate formed on said substrate, said gate disposed between said emitters and receiving a gate voltage, the gate voltage controlling the amount of electrons emitted from said emitters.

13. A magnetron, comprising:

a cold cathode having an electron emitting member, for emitting electrons, the electron emitting member being composed of a field-emission cold cathode array;

a subdivided anode concentrically disposed around the periphery of the cold cathode; and a magnet producing a magnetic field, the magnetic field lying at right angles to an electric field applied between the cold cathode and the subdivided anode, wherein the length of the electron emitting member is $2\pi mE/eB^2$ relative to the moving direction of the electrons emitted from the electron emitting member, wherein $\pi$ is the ratio of the circumference of a circle to its diameter, m is mass of an electron, E is an applied electric field, e is an amount of elementary electric charge, and B is a magnetic field.

14. The magnetron according to claim 13, further comprising means for adjusting output power by adjusting the amount of electrons emitted from the electron emitting member.

15. A magnetron, comprising:

a cold cathode having an electron emitting member, for emitting electrons, the electron emitting member being composed of a field-emission cold cathode array;

a subdivided anode concentrically disposed around the periphery of the cold cathode; and a magnet producing a magnetic field, the magnetic field lying at right angles to an electric field applied between the cold cathode and the subdivided anode, wherein the electron emitting member is divided into two or more sections, and the sections of the electron emitting member are independently controlled to change their respective output power.

16. The magnetron according to claim 15, further comprising a gate formed on each section of the electron emitting member, and means for varying a gate voltage applied to each gate to control the output power of the respective sections.

17. A microwave oven for dielectric-heating a substance placed in a heating room of the oven, comprising:

a magnetron including a planar cold cathode having an electron emitting member for emitting electrons;

a subdivided anode disposed oppositely and parallel with the electron emitting member, the subdivided anode having cavity resonators formed therein at the side of the cold cathode; and a magnet producing a magnetic field, the magnetic field lying at right angles to an electric field applied between the cold cathode and the subdivided anode;

a gate electrode formed between the cold cathode and the subdivided anode of the magnetron; and means for changing microwave output power by varying a gate voltage applied to the gate electrode.

18. The microwave oven according to claim 17, further comprising means for detecting the temperature of the magnetron, wherein the microwave output power changing means lowers the gate voltage to lower the microwave output when the temperature of the magnetron detected by the temperature detecting means goes over a predetermined value.

19. The microwave oven according to claim 17, wherein a plurality of the magnetrons is disposed on a heating room housing, and the microwave oven further comprises controlling means for operating the respective magnetrons at the same time and independently controlling microwave output powers from the respective magnetrons.

20. The microwave oven according to claim 19, further comprising shape recognizing means for recognizing shapes of substances to be heated which are placed in the heating room of the oven, wherein the controlling means adjusts a ratio of microwave outputs for the respective magnetrons depending on the shapes of the substances as recognized by the shape recognizing means.

21. A microwave oven for dielectric-heating a substance placed in a heating room of the oven, comprising:

a magnetron including a planar cold cathode having an electron emitting member for emitting electrons;

a subdivided anode disposed oppositely and parallel with the electron emitting member, the subdivided anode having cavity resonators formed therein at the side of the cold cathode; and a magnet producing a magnetic field, the magnetic field lying at right angles to an electric field applied between the cold cathode and the subdivided anode, wherein the magnetron is equipped to a heating room housing through an electrode of the magnetron, the electrode being electrically insulated against the heating room housing, and a direct current power source which is not insulated against a commercial power source serves as a supply source of the magnetron.

22. The microwave oven according to claim 21, further comprising a gate electrode formed between the cold cathode and the subdivided anode of the magnetron and means for changing microwave output power by varying a gate voltage applied to the gate electrode.

23. A magnetron, comprising:

a generally planar substrate; p1 a cold cathode having an electron emitting member for emitting electrons, said electron emitting member being formed in two coplanar dimensions on said substrate;

a subdivided anode which is disposed oppositely in parallel with the electron emitting member and which has cavity resonators formed therein at the side of the cold cathode; and a magnet producing a magnetic field lying at right angles to an electric field applied between the cold cathode and the subdivided anode, wherein the length of the electron emitting member is less than $2\pi mE/eB^2$ relative to the moving direction of the electrons emitted from the electron emitting member, wherein $\pi$ is the ratio of the circumference of a circle to its diameter, m is mass of an electron, E is an applied electric field, e is an amount of elementary electric charge, and B is a magnetic field.

24. The magnetron according to claim 23, further comprising a gate electrode formed between the cold cathode and the subdivided anode of the magnetron and means for changing microwave output power by varying a gate voltage applied to the gate electrode.

25. A magnetron, comprising:

a cold cathode having an electron emitting member, for emitting electrons, the electron emitting member being composed of a field-emission cold cathode array;

a subdivided anode concentrically disposed around the periphery of the cold cathode; and a magnet producing a magnetic field, the magnetic field lying at right angles to an electric field applied between the cold cathode and the subdivided anode, wherein the length of the electron emitting member is less than $2\pi mE/eB^2$ relative to the moving direction of the electrons emitted from the electron emitting member, wherein $\pi$ is the ratio of the circumference of a circle to its diameter, m is mass of an electron, E is an applied electric field, e is an amount of elementary electric charge, and B is a magnetic field.

26. The magnetron according to claim 25, further comprising a gate electrode formed between the cold cathode and the subdivided anode and means for adjusting output power of the magnetron by adjusting the amount of electrons emitted from the electron emitting member.

* * * * *